United States Patent [19]

Henri et al.

[11] Patent Number: 4,803,098

[45] Date of Patent: Feb. 7, 1989

[54] PROCESS FOR THE PREPARATION OF THE SURFACE OF A URANIUM AND TITANIUM ALLOY MEMBER, PARTICULARLY WITH A VIEW TO CHEMICAL NICKEL PLATING

[75] Inventors: Antoine Henri, Paris; Daniel Lefevre, Longvilliers; Patrick Massicot, Vanves, all of France

[73] Assignee: Commissariat A L'Energie Atomique, Paris, France

[21] Appl. No.: 927,336

[22] Filed: Nov. 5, 1986

[30] Foreign Application Priority Data

Nov. 19, 1985 [FR] France ..... 85 17068

[51] Int. Cl.[4] ..... B05D 3/04; B05D 3/10

[52] U.S. Cl. ..... 427/309; 156/664; 427/329; 427/444

[58] Field of Search ..... 427/309, 444, 305, 328, 427/438, 329; 156/664

[56] References Cited

U.S. PATENT DOCUMENTS

| | | | |
|---|---|---|---|
| 2,928,168 | 3/1960 | Gray | 427/309 |
| 3,373,092 | 3/1968 | Yoshimura et al. | 427/309 |
| 3,674,655 | 7/1972 | de Vaulchier du Deschaux et al. | 204/129.35 |
| 4,024,303 | 5/1977 | Hahn | 427/309 |
| 4,285,782 | 8/1981 | Waldrop et al. | 204/32 R |
| 4,673,585 | 6/1987 | Anzda et al. | 427/309 |

OTHER PUBLICATIONS

*Metal Finishing*, vol. 74, No. 4, Apr., 1976, "Etching and Plating of Uranium Alloys".

*Primary Examiner*—Sadie Childs

*Attorney, Agent, or Firm*—Pearne, Gordon, McCoy & Granger

[57] ABSTRACT

This invention relates to a process for the preparation of a surface of a uranium and titanium alloy, and more specifically to etching the surface of said alloy for purposes of preparing said surface for nickel plating. More specifically, the process comprises chemically etching the surface of the uranium and titanium alloy with a solution comprising lithium chloride and hydrochloric acid. The process of this invention further provides for recovering the uranium dissolved in the etching solution and recycling said solution. The uranium is recovered from the etching solution by means of an ion exchange resin with the etching solution being recycled to the etching process.

11 Claims, No Drawings

PROCESS FOR THE PREPARATION OF THE SURFACE OF A URANIUM AND TITANIUM ALLOY MEMBER, PARTICULARLY WITH A VIEW TO CHEMICAL NICKEL PLATING

BACKGROUND OF THE INVENTION

The present invention relates to a process for the preparation of the surface of a uranium and titanium alloy member, more particularly containing 0.6 to 0.8% by weight titanium, said process being performed with a view to carrying out nickel coating or plating of said member by a chemical nickel plating process.

It is more particularly used in the medical field (protective shield in radiology), the maritime field (ballast or armour plating) and the space field (satellites).

In numerous fields, it is frequently necessary to deposit nickel coatings on uranium and titanium alloy members. These coatings are generally produced by electrolytic nickel plating making it possible to generally obtain coatings with an adequate quality. However, these electrolytic nickel plating processes are not suitable for the treatment of members having a complicated shape with angles and/or holes, because in such cases it is difficult to obtain a nickel deposit of uniform thickness and sometimes even to completely coat the surface of the members. Moreover, in the case of members having a complex shape, it is preferable to deposit the nickel chemically in order to surmount these difficulties.

In the case of a nickel coating produced by chemical nickel plating, in order to obtain a coating having an adequate adhesion, it is necessary to subject the member to a prior surface preparation treatment, which can be carried out by chemical etching. The latter must be uniform and thickness-controllable, so that the prepared member surface is able to receive the nickel deposit.

The presently known surface treatment processes for uranium and titanium alloy members do not make it possible to obtain a thickness-uniform, homogeneous etching over the entire surface of the member to be treated, when the latter has a complex shape.

Moreover, when interest is attached to the reprocessing of solutions containing uranium, the presently used etching solutions for the surface treatment of uranium and titanium alloy members permit little or no recovery of the uranium dissolved during chemical etching. This uranium recovery makes it possible to limit the production of waste and therefore partly obviate the problems connected with the storage of waste.

FR-A No. 1564575 discloses a process for the preparation of a surface of a uranium or uranium alloy member with a view to carrying out electrolytic nickel plating. This process in particular involves an anodic pickling stage carried out in a solution containing a magnesium and/or lithium salt.

This anodic pickling stage is suitable for an electrolytic nickel deposition, but is inappropriate for chemical nickel deposition. In particular, tensile strength tests on the members having undergone said anodic pickling, followed by chemical nickel plating lead to the separation of the nickel coating, which is contrary to the sought objective.

Moreover, the lithium and/or magnesium salts used in the aforementioned patent specification do not permit the recovery of the uranium dissolved in the electrolytic solution, as a result of the complexing of the uranium with the anion of said salts and/or rapidly poison the system for the extraction of the dissolved uranium, so that said system rapidly becomes unusable, which is particularly the case with $SO_4^-$ ions.

SUMMARY OF THE INVENTION

The present invention relates to a process for the preparation of the surface of a uranium and titanium alloy member, more particularly making it possible to obviate the aforementioned disadvantages. This process involves a chemical etching stage of the surface of the member and permits both a good preparation of said surface and consequently a uniform, tight nickel deposition chemically, as well as a maximum recovery of the uranium dissolved in the etching solution.

According to the main feature of the invention, chemical etching takes place to the surface of the uranium and titanium alloy member using a lithium chloride-based solution.

The choice of a lithium chloride (LiCl) etching solution makes it possible to obtain a satisfactory surface state over the entire member, even when the latter has a complicated shape. Moreover, the etched thickness as a function of the time is linear, which makes it possible to very satisfactorily control the etching.

Moreover, the lithium chloride solution is easy to provide, because it does not evolve over a period of time. Thus, the in situ production of hydrochloric acid (HCl) by reaction between the lithium chloride and the water remains very limited. Thus, the etching solution has a good storage stability.

Advantageously, the etching solution according to the invention contains hydrochloric acid. Bearing in mind the time-stability of the solution according to the invention, there is no need to continuously dose hydrochloric acid present in the solution, it merely being necessary to carry out a daily acid readjustment during the use of the solution.

Advantageously the etching solution according to the invention contains 400 to 500 g/l of lithium chloride and e.g. 460 g/l and 0.8 to 1.2 mol/l of hydrochloric acid, e.g. 1 mol/l.

Lithium chloride concentrations exceeding 500 g/l and hydrochloric acid concentrations exceeding 1.5 mol/l lead to excessive etching of the uranium and titanium alloy member causing a passable surface state. In the same way, lithium chloride concentrations below 400 g/l and/or hydrochloric acid concentrations below 0.8 mol/l cause no etching of the uranium and titanium alloy member.

According to the invention, chemical etching takes place hot, i.e. at temperatures between 30° and 50° C. and e.g. 40° C.

In view of the great chemical reactivity of uranium, prior to carrying out chemical etching, it is generally preferable to subject the uranium and titanium alloy member to at least one of the following treatments: scouring by an organic solvent, sand blasting, pickling with a soda solution and pickling with a nitric acid solution.

In the same way, following the chemical etching stage, it is preferable to subject the uranium and titanium alloy member to pickling by a nitric acid solution and/or pickling by a soda solution.

The pickling operation or operations by means of the soda solution can be carried out hot, i.e. at temperatures between 70° and 80° C. and e.g. at 75° C.

According to a preferred embodiment of the inventive process, the process for the preparation of the surface of a uranium and titanium alloy member comprises the stages of scouring with an organic solvent, wet sand blasting, hot pickling using a soda solution, followed by rinsing water, pickling with a nitric acid solution, followed by rinsing with water, chemical etching with a lithium chloride-based solution, followed by rinsing with water, pickling with a nitric acid solution, followed by rinsing with water, pickling with a soda solution, followed by rinsing with water and pickling with a nitric acid solution, followed by rinsing with water.

All these operations make it possible to obtain a surface state for the member of a satisfactory quality, particularly when the treated member is a uranium and titanium alloy member containing 0.75% by weight titanium.

Generally, the nitric acid solution pickling operations are performed at ambient temperature (20° C.) for periods between 8 and 15 minutes. This acid solution contains 7 to 9 mol/l of nitric acid and e.g. 8 mol/l.

For the soda solution pickling stages, working generally takes place at a temperature of 70° to 80° C. and use is made of a solution containing 250 to 350 g/l of soda and e.g. 300 g/l. This alkaline pickling can last between 3 and 7 minutes.

The uranium and titanium alloy members treated by the process according to the invention can then be coated with nickel by chemical nickel plating in an aqueous solution. For said nickel plating, it is possible to use NIPOSIT 65 solutions marketed by SHIPPLEY S.A.

As has been stated hereinbefore, the lithium chloride-based solution according to the invention makes it possible, following etching a uranium and titanium alloy member, to recover the uranium dissolved in the solution, which permits a recycling of the etching solution and consequently its subsequent reuse for other surface preparations of uranium-titanium members. The recovery of the uranium dissolved in the etching solution is preferably carried out by means of an ion exchange resin.

On the basis of the absorption curves of metal cations in hydrochloric solution on ion exchange resins, more particularly published in the book entitled "Modern Methods for the Separation of rarer metal ions", published by Pergamon, author Joann Korkisch, University of Vienna, Austria, 1969, it is possible to see that lithium is not fixed on the active group of the resins, whereas uranium remains trapped.

The ion exchange resin usable within the scope of the invention is a strong base anionic resin. Uranium in a lithium chloride solution is oxidized to valency VI by a 0.1 molar nitric acid solution. The ions then present in this solution are anions $(UO_2Cl_3)^-$ and $(UO_2Cl_4)^{2-}$.

The anionic resin can be constituted by resins whose active group is a pyridinium cation or a group in accordance with the formula $—CH_2—N—(CH_3)_3^+$.

The uranium fixed to the ion exchange resin is then eluted by a 1 mol/l hydrochloric acid solution and the solution obtained is then concentrated for a subsequent chemical treatment.

DETAILED DESCRIPTION OF THE INVENTION

The invention will be better understood from reading the following examples given in an illustrative and non-limitative manner. These examples relate to the treatment of a uranium and titanium alloy member with 0.7% by weight titanium ($UTi_{0.7}$) in the form of cylinders or pellets.

Five $UTi_{0.7}$ members underwent a surface treatment according to the invention comprising the following successive stages:

cold scouring using an organic solvent, such as trichloroethylene, wet sand blasting under a pressure of 3 bars with an alumina powder with approximately 50 μm diameter grains, followed by rinsing with water, pickling with a soda solution of 300 g/l at 75° C. for 5 minutes, followed by rinsing with soft water, pickling by a 8 mol/l nitric acid solution for 12 minutes at 20° C., followed by rinsing with soft water, first chemical etching using a lithium chloride solution containing 460 g/l of LiCl and 1 mol/l of HCl at a temperature of 40° C. for 5 minutes, followed by rinsing with soft water, pickling with a 8 mol/l nitric acid solution at 20° C. for 12 minutes, followed by rinsing with soft water, pickling by a 300 g/l soda solution at 75° C. for 5 minutes, followed by rinsing with soft water, pickling by a 8 mol/l nitric acid solution at 20° C. for 12 minutes, followed by rinsing with soft water, second chemical etching by a lithium chloride solution at 40° C. for 5 minutes, containing 460 g/l of LiCl and 1 mol/l of HCl, followed by rinsing with soft water, pickling in a 8 mol/l nitric acid solution at 20° C. for 12 minutes, followed by rinsing with soft water, pickling by a 300 g/l soda solution at 75° C. for 5 minutes, followed by rinsing with soft water, and pickling by a 8 mol/l nitric acid solution at a temperature of 20° C. for 12 minutes, followed by rinsing with soft water.

On five $UTi_{0.7}$ members treated in this way was then placed a nickel coating by chemical nickel plating in a SHIPPLEY NiP65 bath. This nickel plating was carried out by successive depositions, each followed by a heat treatment consisting of degassing or baking the thus obtained member at 200° C. for 2 hours.

These nickel-plated uranium-titanium alloy members then underwent accelerated corrosion testing in a saline mist containing 5% by weight NaCl at a temperature of 30° C. The members spent more than 100 hours in the saline mist. The results of the test are given in the following table I, the five members being designated 1 to 5.

It can be gathered from table I that the corrosion characteristics of the $UTi_{0.7}$ members treated in accordance with the process of the invention and then chemically nickel plated comply with the conventionally fixed standards. Thus, there was no pitting on the treated members after testing for 100 hours under accelerated corrosion conditions.

Thus, the uranium-titanium members surface treated by the process according to the invention and chemically nickel plated can be used in a marine atmosphere and can in particular be used for ballast or armour plating.

In addition, two $UTi_{0.7}$ members were treated using the surface preparation process described in FR-A No. 1564575. Anodic pickling was carried out in a zero pH and 4N $Li^+$ lithium sulphate solution for 50 minutes. The etching obtained is homogeneous but inadequate at first sight.

These two members were then nickel coated by chemical nickel plating, followed by heat treatment. Nickel plating and heat treatment were carried out under the same operating conditions as those used for the five $UTi_{0.7}$ members treated according to the invention.

The results obtained are also given in table I. The two members which underwent anodic pickling are designated 6 and 7.

Blisters appeared after the heat treatment and show the importance of the chemical etching according to the invention for subsequent chemical nickel plating.

In the same way, a $UTi_{0.7}$ member underwent the surface preparation process described in FR-A No. 1564575, anodic pickling being carried out in a lithium acetate solution and then on said member was carried out chemical nickel plating and heat treatment under the same conditions as hereinbefore.

The nickel coating cracked after the heat treatment, which once again illustrates the importance of the chemical etching according to the invention for subsequent chemical nickel plating.

Finally, two uranium and vanadium alloy members with 0.2% by weight vanadium ($UV_{0.2}$) underwent chemical etching by a LiCl and HCl solution according to the invention. The etching obtained was inadequate and certain regions of the two members were not etched. Chemical etching according to the invention is consequently unsuitable for $UV_{0.2}$ members.

The etching solution according to the invention is specific to the uranium and titanium alloy members.

The following description relates to the recovery of the uranium dissolved in a LiCl etching solution by means of a strong base anionic resin, whose active group is a pyridinium cation.

Determination took place for a first lithium chloride solution containing 460 g/l of LiCl, 1 mol/l of HCl and 54 g/l of uranium and a second solution containing 460 g/l of LiCl, 1 mol/l of HCl and 20 g/l of uranium of the partition coefficient D and the fixing capacity C of the resin. The coefficients C and D are defined as below:

$$D = \frac{\text{uranium mass/g of dry resin}}{\text{uranium mass remaining in solution}}.$$

$C$ = uranium mass/g of dry resin in milliequivalent units per g of dry resin.

The results are given in the following table II.

TABLE II

| Test | D | C |
|---|---|---|
| 1 | $4 \times 10^3$ | 7.8 |
| 2 | $3.5 \times 10^3$ | 7.8 |

The partition coefficient of approximately 4000 is very satisfactory for envisaging the recovery of the uranium dissolved in a LiCl etching solution by the ion exchange resin method and consequently the recycling of the lithium chloride etching solution for carrying out other surface preparations of the uranium and titanium alloy members.

TABLE I

| Test | Number of Ni deposits | Number of heat treatments | Nickel thickness in um | Appearance of pitting |
|---|---|---|---|---|
| 1 | 2 | 2 | 63 | No |
| 2 | 2 | 2 | 63 | No |
| 3 | 2 | 2 | 70 | No |
| 4 | 2 | 2 | 70 | No |
| 5 | 2 | 2 | 70 | No |
| 6 | 2 | 2 | 60 | No saline mist testing, because blisters appeared after heat treatment |
| 7 | 2 | 2 | 60 | |

What is claimed is:

1. A process for preparing the surface of a uranium and titanium alloy which comprises chemically etching said surface with an etching solution containing effective amounts of lithium chloride and hydrochloric acid, subsequently recovering uranium from the etching solution and recycling said solution to the etching process.

2. The process of claim 1, wherein the etching solution contains 400 to 500 grams of lithium chloride per liter of solution.

3. The process of claim 1, wherein the hydrochloric acid is present at a concentration of about 0.8 to 1.2 mols per liter.

4. The process of claim 1, wherein the etching solution contains approximately 460 grams of lithium chloride per liter and about 1 mol of hydrochloric acid per liter.

5. The process of claim 1, wherein the chemical etching is performed at temperatures ranging between 30° and 50° C.

6. The process of claim 1, wherein, prior to chemical etching of the surface of the alloy, said surface is subjected to at least one of the treatments selected from the group consisting of (a) scouring the surface with an organic solvent, (b) sandblasting the surface, (c) pickling the surface with a soda solution, and (d) pickling the surface with a nitric acid solution.

7. The process of claim 1, wherein, following the chemical etching of the alloy surface, said surface is subjected to at least one of the treatments selected from the group consisting of (a) pickling the alloy surface with a nitric acid solution and (b) pickling the alloy surface with a soda solution.

8. The process of claim 7, wherein the pickling treatment is performed at a temperature ranging from about 70° to 80° C.

9. The process of claim 1, wherein the surface of a uranium and titanium alloy is treated by the following successive steps:

(a) scouring the surface with an organic solvent;
(b) sandblasting the surface;
(c) hot pickling the surface with a soda solution followed by a water rinse;
(d) scouring the surface with a nitric acid solution, followed by a water rinse;
(e) etching the surface with a lithium chloride and hydrochloric acid solution, followed by a water rinse;
(f) pickling the surface with a nitric acid solution, followed by a water rinse;
(g) pickling the surface with a soda solution, followed by a water rinse; and
(h) pickling the surface with a nitric acid solution.

10. The process of claim 1, further characterized in that the uranium is recovered by means of an ion exchange resin.

11. The process of claim 1, further characterized in that the ion exchange resin is an anionic resin.

* * * * *